US006905183B2

(12) United States Patent
Leimkuehler et al.

(10) Patent No.: US 6,905,183 B2
(45) Date of Patent: Jun. 14, 2005

(54) TILT-OUT DOOR BUCKETS FOR REFRIGERATORS OR FREEZERS

(75) Inventors: Scott W. Leimkuehler, Swisher, IA (US); Roger K. Bush, Aiken, SC (US); Michael J. Eveland, Cedar Rapids, IA (US); Todd E. Kniffen, Williamsburg, IA (US); J. Michael Nurre, Cedar Rapids, IA (US); Ravi Kumar Sawhney, Calabasas, CA (US); Timothy Mark Nugent, Venice, CA (US); John Frank Zinni, Capistrano Beach, CA (US)

(73) Assignee: Maytag Corporation, Newton, IA (US)

( * ) Notice: Subject to any disclaimer, the term of this patent is extended or adjusted under 35 U.S.C. 154(b) by 66 days.

(21) Appl. No.: 10/195,675

(22) Filed: Jul. 15, 2002

(65) Prior Publication Data

US 2003/0020386 A1 Jan. 30, 2003

Related U.S. Application Data

(60) Provisional application No. 60/305,716, filed on Jul. 16, 2001.

(51) Int. Cl.[7] ..... A47B 96/02
(52) U.S. Cl. ..... 312/405.1
(58) Field of Search ..... 312/400, 401, 312/402, 405, 405.1, 408, 321.5; 62/377

(56) References Cited

U.S. PATENT DOCUMENTS

| | | | | | |
|---|---|---|---|---|---|
| 2,012,262 | A | * | 8/1935 | Forsthoefel | 312/271 |
| 2,155,967 | A | | 4/1939 | Carroll | |
| 2,576,691 | A | * | 11/1951 | Money | 312/405.1 |
| 2,694,906 | A | * | 11/1954 | Didion | 62/326 |
| 2,894,379 | A | | 7/1959 | Saunders | |
| 2,898,173 | A | * | 8/1959 | Squire | 312/248 |
| 4,186,978 | A | | 2/1980 | Thomson | |
| 4,798,425 | A | | 1/1989 | Frank | |
| 5,513,910 | A | | 5/1996 | Ellingwood et al. | |
| 6,074,030 | A | | 6/2000 | Prunty et al. | |

FOREIGN PATENT DOCUMENTS

| | | | | |
|---|---|---|---|---|
| DE | 1105892 | * | 5/1961 | 312/405.1 |

* cited by examiner

*Primary Examiner*—James O. Hansen
(74) *Attorney, Agent, or Firm*—McKee, Voorhees & Sease, P.L.C.

(57) ABSTRACT

An improved door bucket assembly is provided for a refrigerator or freezer door. The assembly includes a bucket pivotally mounted in a retainer mounted in the door, such that the bucket is movable between an upright position and tilt-out position. The bucket is open at the top such that items stored in the bucket are accessible when the bucket is in both the upright and tilt-out positions. A stop member limits the tilt-out movement of the bucket to 30°–45°. A clip on the retainer releasably engages a tab on the bucket to prevent accidental tilt-out of the bucket during movement of the door between open and closed positions.

18 Claims, 4 Drawing Sheets

TILT-OUT DOOR BUCKETS FOR REFRIGERATORS OR FREEZERS

CROSS-REFERENCE TO RELATED APPLICATIONS

This application claims priority to provisional application U.S. Ser. No. 60/305,716 filed on Jul. 16, 2001.

BACKGROUND OF THE INVENTION

Refrigerators and freezers typically have doors with storage shelves or compartments therein. The compartment may be a shelf with a pivotal door or may be formed with upright walls and an open top. Some refrigerator and freezer doors have a tilt-out bucket to provide easier access to the stored food item. Such buckets are typically accessible only in the tilt-out or open position, with the bucket opening being inaccessible when the bucket is moved to the storage position within the door. Such tilt-out buckets also have a problem with inadvertently tilting-out when not desired, particularly when the refrigerator or freezer door is opened quickly. Such unintentional pivoting of the bucket to the open position presents the potential for spillage of the food items from the bucket. Some tilt-out buckets include a lid or cover which can be opened only after the bucket has been pivoted to the tilt-out position. Such lids add an additional step to the process of removing a food item from the bucket, and may present difficulties in opening the lid by a user having both hands full.

Accordingly, a primary objective of the present invention is the provision of an improved tilt-out bucket for a refrigerator or freezer door.

Another objective of the present invention is the provision of a tilt-out door bucket for refrigerators and freezers which pivots 30°–45° to enhance access to food items contained in the bucket.

A further objective of the present invention is the provision of an improved tilt-out bucket for refrigerator or freezer doors which is restrained against inadvertent pivotal movement from an upright position to a tilt-out position.

Another objective of the present invention is the provision of an improved tilt-out door bucket for a refrigerator or freezer door having a positive stop element to limit the pivotal movement of the bucket.

Still another objective of the present invention is the provision of a method of providing access to a refrigerator door bucket including the steps of opening the refrigerator or freezer door and tilting the bucket from an upright position wherein an opening of the bucket is upwardly disposed to a tilt-out position wherein the bucket opening is upwardly and forwardly disposed.

Another objective of the present invention is the provision of an improved tilt-out door bucket for refrigerator and freezers which is economical to manufacture and durable in use.

These and other objectives will become apparent from the following description of the invention.

SUMMARY OF THE INVENTION

The present invention is directed towards an improved tilt-out door bucket assembly for a refrigerator or freezer door. The assembly includes a retainer mounted in the door and a bucket mounted in the retainer. The retainer has a raised channel at the lower front edge and the bucket has a recess in the lower front edge to receive the channel to define a pivot axis for the bucket. The retainer has stop members at opposite ends adapted to engage corresponding surfaces on opposite ends of the bucket to limit the tiltout movement of the bucket to approximately 30°–45°. The retainer also has at least one clip adapted to releasably engage a tab on the bucket to preclude the bucket from inadvertently pivoting to the tilt-out position when the door is opened and closed.

DETAILED DESCRIPTION OF THE INVENTION

Figure 1:
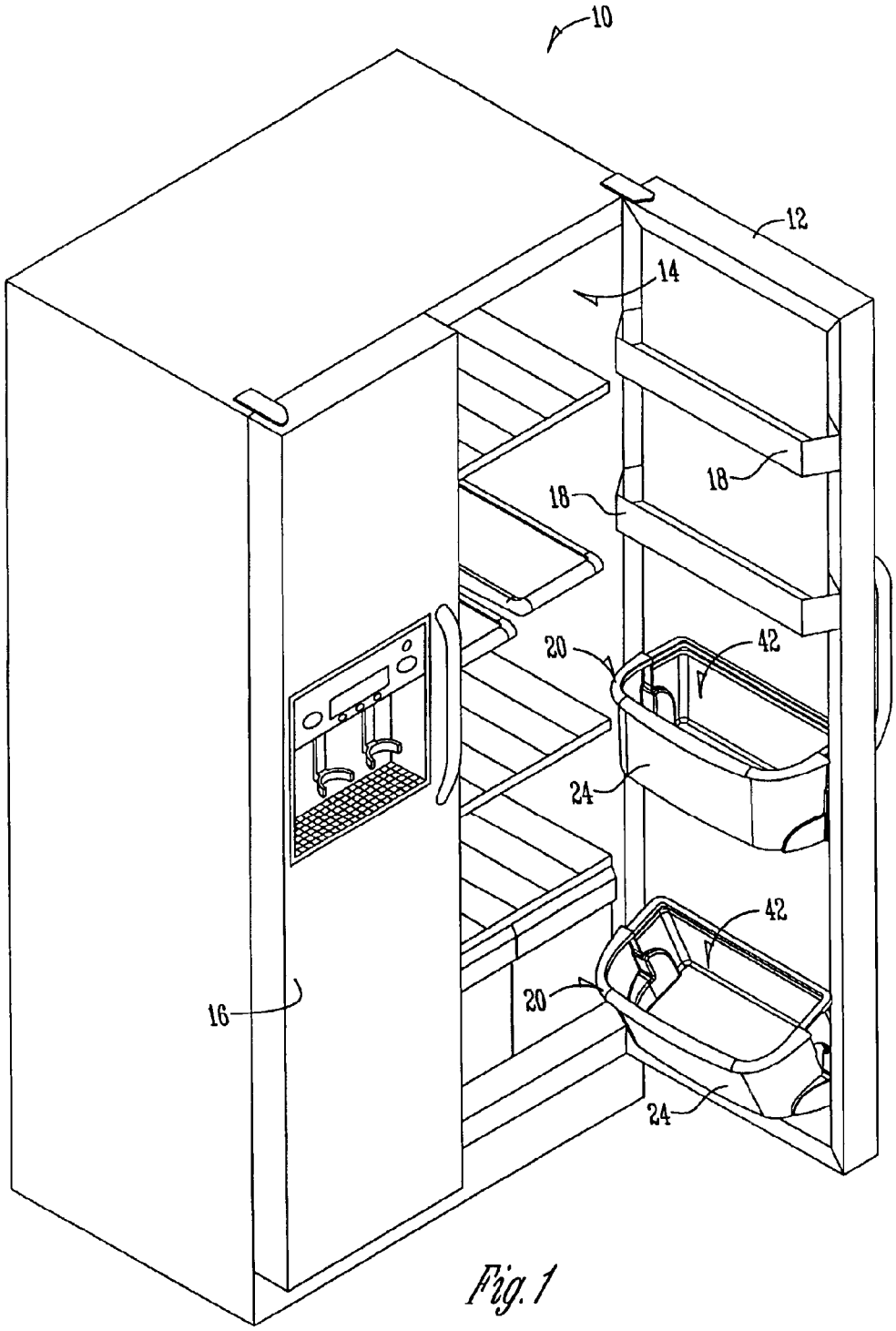
FIG. 1 is a perspective view of a refrigerator showing the tilt-out bucket of the present invention mounted in the refrigerator door.

A refrigerator 10 is shown in FIG. 1 with a door 12 for the fresh food compartment 14 and a door 16 for the freezer compartment. While FIG. 1 shows a side-by-side refrigerator, it is understood that the present invention can be utilized on other refrigerator styles, such as models wherein the freezer is provided above or below the fresh food compartment.

The door 12 is shown to include a plurality of shelves 18 for storage of food items. The present invention is directed towards a tilt-out bucket assembly 20 which is also provided in the door 12 or the door 16 for storage of food items. While FIG. 1 shows the bucket assembly 20 to be mounted in the refrigerator door 12, it is understood that the bucket assembly 20 can also be utilized in the freezer door 16.

Figure 2:
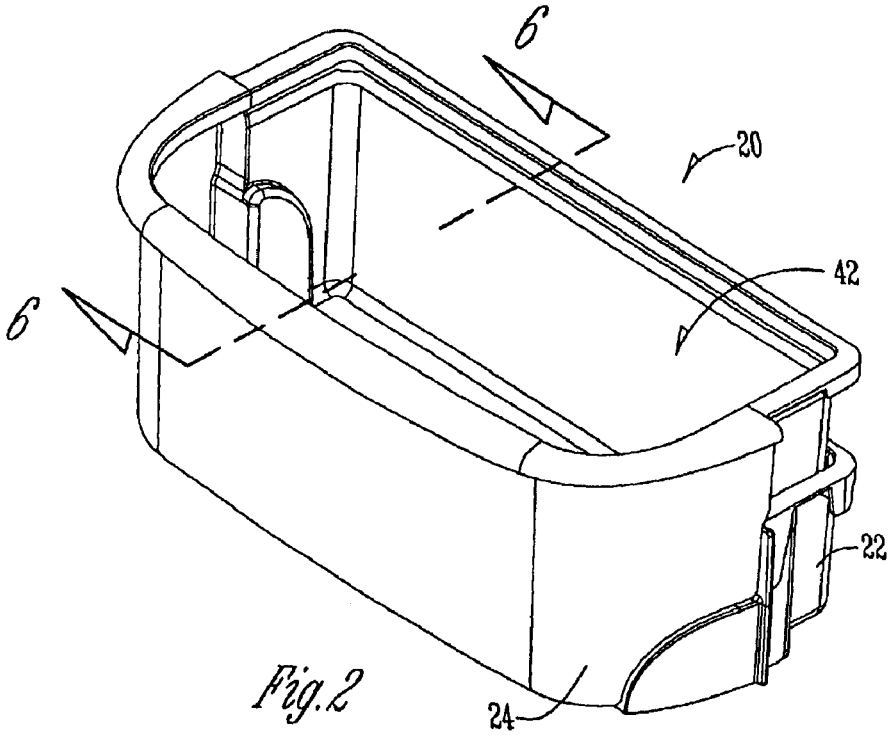
FIG. 2 is a perspective view of the tilt-out bucket assembly of the present invention in an upright position.
Figure 3:
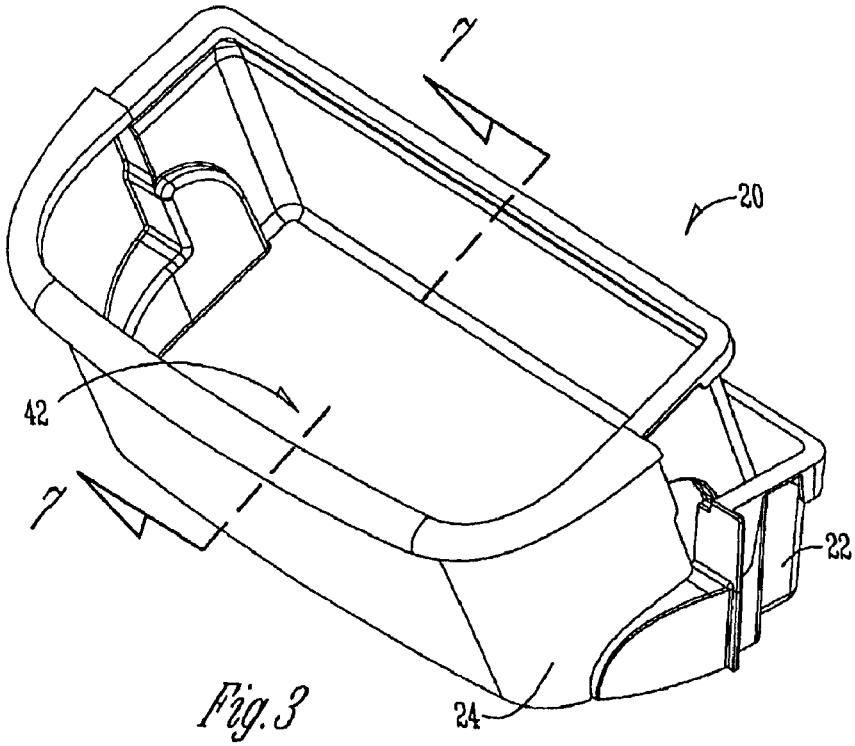
FIG. 3 is a perspective view of the tilt-out bucket assembly of the present invention in a tilt-out position.

The bucket assembly 20 generally includes a retainer 22 and a bucket 24. The retainer 22 is mounted in the door 12 so as to be fixed thereto. The bucket 24 simply sits in the retainer 22 and pivots between an upright position, shown in FIG. 2, and a tilt-out position, shown in FIG. 3.

Figure 5:
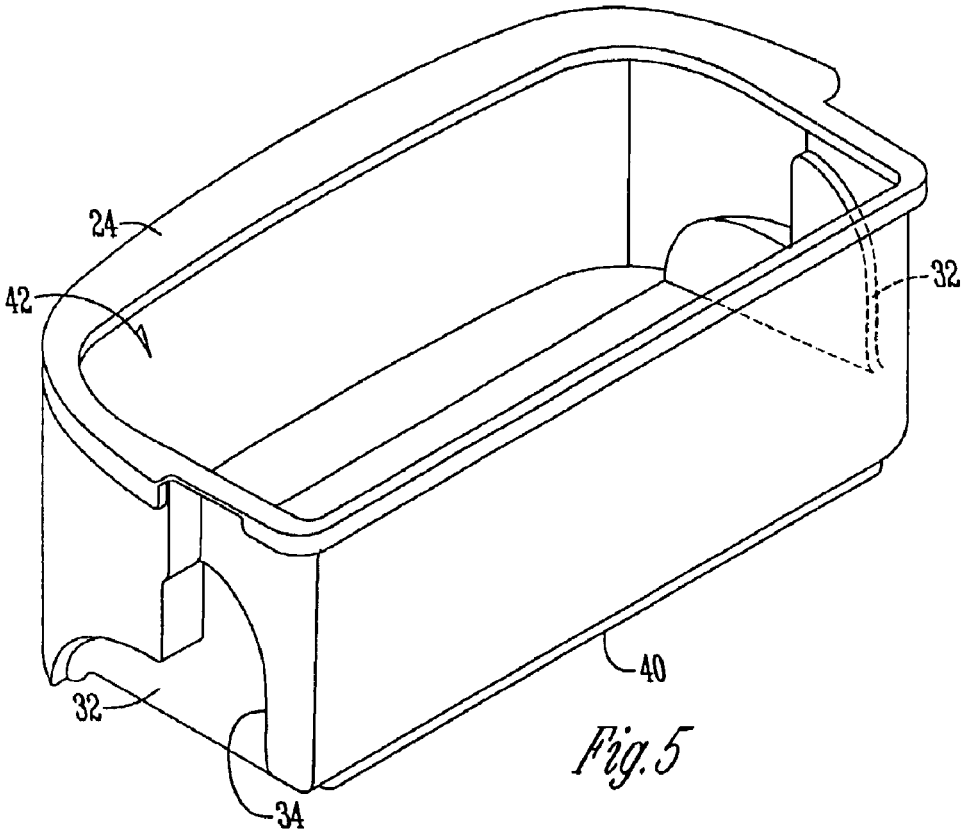
FIG. 5 is a perspective view of the bucket of the bucket assembly of the present invention.
Figure 6:
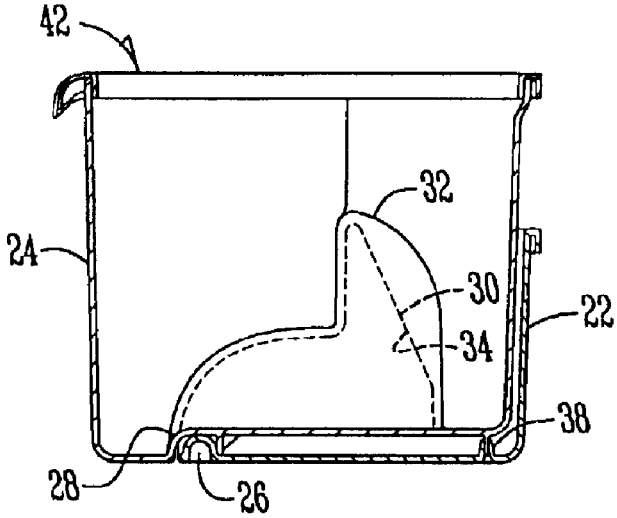
FIG. 6 is a sectional view taken along lines 6—6 of FIG. 2.
Figure 7:
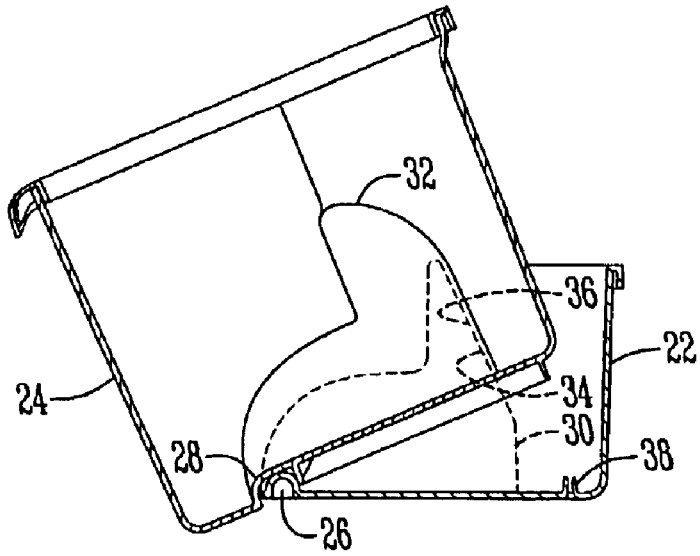
FIG. 7 is a sectional view taken along lines 7—7 of FIG. 3.

More particularly, the retainer 22 includes a raised rib or channel 26, and the bucket 24 has a mating groove or recess 28, as best seen in FIGS. 5 and 6. The channel 26 and the recess 28 define a pivot axis for the bucket 24.

The tilt-out movement of the bucket 24 is limited to approximately 30°–45° by a stop member 30 on each end of the retainer 22. The stop member 30 is received within a recess or pocket 32 on each side of the bucket 24. The bucket 24 is free to pivot between the upright and tilt-out positions until a rear surface 34 on the pocket 32 engages a rear sloped surface 36 on the stop member 30, as best seen in FIG. 6. Thus, the surfaces, 34 and 36 on the bucket 24 and retainer 22 cooperate to limit the tilt-out movement of the bucket 24.

Figure 4:
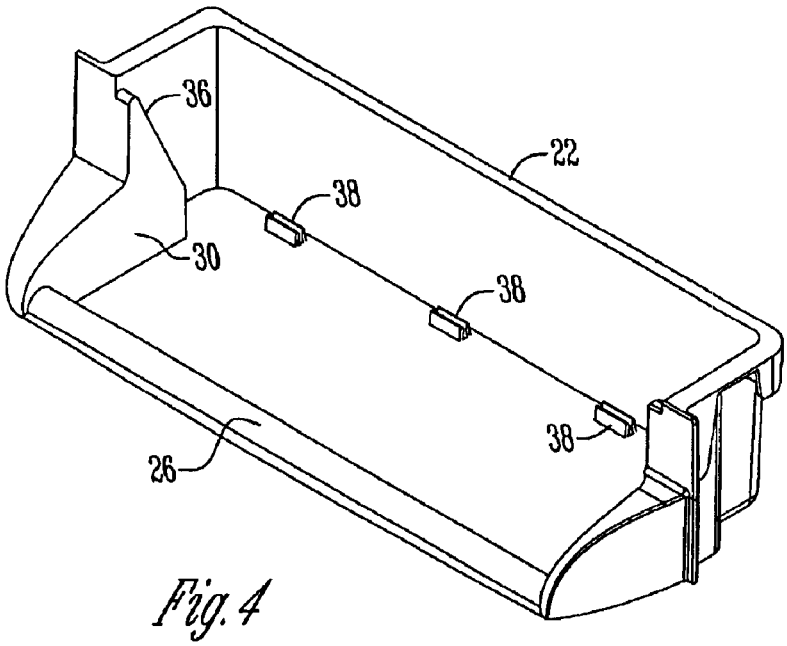
FIG. 4 is a perspective view of the retainer of the bucket assembly of the present invention.

The retainer 22 also includes one or more clips 38 extending upwardly from the bottom of the retainer 22 adjacent the rear portion thereof. The clips 38 are adapted to receive a leg or tab 40 extending downwardly from the bottom of the bucket 24 adjacent the rearward edge thereof, as best shown in FIG. 5. The male tab 40 is thus releasably received in the female clips 38 when the bucket is in the upright position to lock the retainer 22 and bucket 24 together and preclude inadvertent or accidental tilt-out of the bucket when the door 12 is moved between the open and closed positions. It is understood that a single clip 38 may be sufficient, rather than the multiple clips 38 shown in FIG. 4. Also, the tab 40 may be a single elongated tab or multiple tabs corresponding to the multiple clips 38. The lock or retention means may also take other forms of frictionally overlapping portions of the retainer 22 and bucket 24.

As seen in the drawings, the upper opening 42 of the bucket 24 is upwardly disposed when the bucket 24 is in the upright position. The opening 42 of the bucket 24 is forwardly and upwardly disposed when the bucket is in the tilt-out position. While food items in the bucket 24 may be accessed when the bucket is in the upright position, the tiltout position of the bucket enhances accessibility. Since the bucket only tilts 30°–45°, there is no need for a lid or cover on the bucket 24.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A refrigerator, comprising:

a food storage compartment;

a door movable between open and closed positions relative to the food compartment;

a retainer in the door;

a bucket pivotally mounted in the retainer for movement between an upright position and a tilt-out position, the bucket being open at the top such that items stored in the bucket are accessible when the bucket is in both the upright and tilt-out positions;

the retainer and the bucket having portions which frictionally overlap when the bucket is in the upright position to prevent the bucket from unintentionally moving to the tilt-out position; and the frictionally overlapping portions being a clip and a tab which engage one another when the bucket is in the upright position and disengage one another when the bucket is manually moved to the tilt-out position.

2. The door bucket of claim 1 wherein the frictionally overlapping portions are releasably mating male and female members to lock the bucket against accidental movement to the tilt-out position.

3. The refrigerator of claim 1 wherein the retainer has a portion defining a pivot axis for the bucket.

4. The refrigerator of claim 1 wherein the retainer has opposite ends and a stop member at each end adapted to engage a surface on the bucket to prevent the bucket from moving past the tilt-out position.

5. The refrigerator of claim wherein the bucket pivots between 30°–45° between the upright and tilt-out positions.

6. A refrigerator, comprising:

a food storage compartment;

a door movable between open and closed positions relative to the food compartment;

a retainer in the door;

a bucket pivotally mounted in the retainer for movement between an upright position and a tilt-out position, the bucket being open at the top such that items stored in the bucket are accessible when the bucket is in both the upright and tilt-out positions;

the retainer and the bucket having portions which frictionally overlap when the bucket is in the upright position to prevent the bucket from unintentionally moving to the tilt-out position; and the frictionally overlapping portions including a clip on the retainer and a tab on the bucket for receipt in the clip when the bucket is in the upright position to preclude the bucket from moving to the tilt-out position during opening and closing of the door.

7. A door bucket assembly for a refrigerator or freezer door, comprising:

a retainer mounted in the door;

a bucket mounted in the retainer and having an open upper end, the bucket being adapted to move between an upright position wherein the upper end is upwardly disposed and a tilt-out position wherein the upper end is angled outwardly from the door, the open upper end permitting access to stored items when the bucket is in both the upright and tilt-out positions;

the retainer and the bucket having portions which frictionally overlap when the bucket is in the upright position to prevent the bucket from unintentionally moving to the tilt-out position; and the frictionally overlapping portions being a clip and a tab which engage one another when the bucket is in the upright position and disengage one another when the bucket is manually moved to the tilt-out position.

8. The door bucket of claim 7 further comprising a stop member cooperating between the retainer and the bucket to limit the movement of the bucket beyond the tilt-out position.

9. The door bucket of claim 7 wherein the retainer has opposite ends and a stop member at each end adapted to engage a surface on the bucket to prevent the bucket from moving past the tilt-out position.

10. The door bucket of claim 7 wherein the bucket is pivotally movable about a lower front edge.

11. The door bucket of claim 10 wherein the retainer has a lower front edge with a raised channel and the bucket has a recess in the lower front edge to receive the channel for pivotal movement about the channel.

12. The door bucket of claim 7 wherein the bucket pivots 30°–45° between the upright and tilt-out positions.

13. A door bucket assembly for a refrigerator or freezer door, comprising:

a retainer mounted in the door;

a bucket mounted in the retainer and having an open upper end, the bucket being adapted to move between an upright position wherein the upper end is upwardly disposed and a tilt-out position wherein the upper end is angled outwardly from the door, the open upper end permitting access to stored items when the bucket is in both the upright and tilt-out positions;

the retainer and the bucket having portions which frictionally overlap when the bucket is in the upright position to prevent the bucket from unintentionally moving to the tilt-out position; and the frictionally overlapping portions including a clip on the retainer and a tab on the bucket for receipt in the clip when the bucket is in the upright position to preclude the bucket from moving to the tilt-out position during opening and closing of the door.

14. A door bucket assembly for a refrigerator or freezer door, comprising:

a retainer mounted in the door;

a bucket mounted in the retainer and having an open upper end, the bucket being adapted to move between an upright position wherein the upper end is upwardly disposed and a tilt-out position wherein the upper end is angled outwardly from the door, the open upper end permitting access to stored items when the bucket is in both the upright and tilt-out positions;

the retainer and the bucket having portions which frictionally overlap when the bucket is in the upright position to prevent the bucket from unintentionally moving to the tilt-out position;

the bucket being pivotally movable about a lower front edge; and the retainer having a lower front edge with a raised channel and the bucket having a recess in the lower front edge to receive the channel for pivotal movement about the channel.

15. The door bucket of claim 14 wherein the retainer defines a pivot axis for the bucket.

16. The door bucket of claim 14 further comprising a stop member cooperating between the retainer and the bucket to limit the movement of the bucket beyond the tilt-out position.

17. The door bucket of claim 14 wherein the retainer opposite ends and a stop member at each end adapted to engage a surface on the bucket to prevent the bucket from moving past the tilt-out position.

18. The door bucket of claim 14 wherein the bucket pivots 30°–45° between the upright and tilt-out positions.

* * * * *